United States Patent [19]

Tsunoda et al.

[11] 4,003,747

[45] Jan. 18, 1977

[54] PHOTOSENSITIVE AZIDE COMPOUND CONTAINING COLOR-FORMING ELEMENT

[75] Inventors: Takahiro Tsunoda, Funabashi; Minoru Ozutsumi, Tokyo; Shigeo Maeda, Tokyo; Susumu Suzuka, Tokyo; Hidetoshi Komiya, Tokyo, all of Japan

[73] Assignees: Hodogaya Chemical Co., Ltd.; Oji Paper Co., Ltd., both of Tokyo, Japan

[22] Filed: Sept. 4, 1975

[21] Appl. No.: 610,400

[30] Foreign Application Priority Data

Sept. 9, 1974 Japan ..... 49-102911

[52] U.S. Cl. ..... 96/75; 96/33; 96/35.1; 96/36; 96/36.2; 96/36.3; 96/49; 96/85; 96/86 R; 96/86 P; 96/87 R; 96/91 N; 96/115 R

[51] Int. Cl.[2] ..... G03C 1/58; G03C 1/72

[58] Field of Search ..... 96/91 N, 91 R, 75, 49, 96/33

[56] References Cited

UNITED STATES PATENTS

| | | | |
|---|---|---|---|
| 1,760,780 | 9/1927 | Schmidt et al. | 96/91 R |
| 1,845,989 | 2/1932 | Schmidt et al. | 96/91 N |
| 2,690,968 | 10/1954 | Powers | 96/91 N |
| 2,692,826 | 10/1954 | Neugebauer et al. | 96/91 N |
| 3,062,650 | 11/1962 | Sagura et al. | 96/90 R |
| 3,092,494 | 6/1963 | Sus et al. | 96/33 |
| 3,174,860 | 3/1965 | Sus et al. | 96/33 |
| 3,235,383 | 2/1966 | Steppan et al. | 96/91 R |
| 3,679,419 | 7/1972 | Gillich | 96/91 R |
| 3,856,531 | 12/1974 | Grisdale et al. | 96/91 N |
| 3,867,147 | 2/1975 | Teuscher | 96/91 R |

*Primary Examiner*—Charles L. Bowers, Jr.
*Attorney, Agent, or Firm*—Paul & Paul

[57] ABSTRACT

A photosensitive color-forming element comprises a support and a photosensitive color-forming layer carried on the support and containing therein a color-forming coupler, for example, 1-naphthol, 2-naphthol and 2,4-dichloro-1-naphthol, and a photosensitive azido compound of the formula (I) or (II):

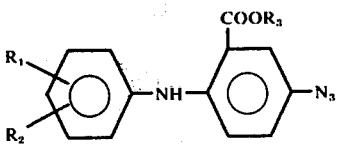

(I)

or

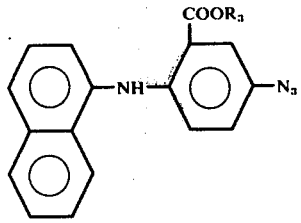

(II)

wherein $R_1$ represents a hydrogen or halogen atom or an alkyl, alkoxyl, diethylamino or hydroxyl radical $R_2$ an alkyl, alkoxyl or hydroxyl radical, and $R_3$ a hydrogen atom or an alkyl or phenyl radical, and, if necessary, a polymeric material capable of hardening or being insolubilized in solvent when the polymeric material is exposed to radiation rays in the presence of the above azido compound, the above-mentioned azido compound and color-forming coupler being capable of forming a dark color upon exposure to radiation rays, without a color-developing agent.

9 Claims, No Drawings

PHOTOSENSITIVE AZIDE COMPOUND CONTAINING COLOR-FORMING ELEMENT

The present invention concerns a photosensitive color-forming element. More particularly, the present invention relates to a photosensitive color-forming element having a photosensitive color forming layer containing a special azido compound and a color-forming coupler, formed on a support.

It is known that a two-component diazo composition containing a diazonium salt and a color-forming coupler is capable of reacting with the diazonium salt in an alkaline condition to form an azo dye which is usable for producing color images in photography. The components of the two-component diazo composition were disclosed in detail in Kosar's "Light-Sensitive Systems", Capater 6, published in 1965 by John Wiley & Sons, New York. However, this type of photography has disadvantages in that the background of the photographic element is possibly stained by deterioration products of the diazo composition during storage and the developer for the diazo composition is required to contain ammonia which is harmful to the human body.

It is also known from, for example, U.S. Pat. Nos. 2,692,826 and 3,092,494 that certain types of aromatic azido compounds, for example, salts and anilide of 4,4'-diaziodostilbene-2,2'-disulfonic acid, 4-phenylamino-3-(N-alkyl (or-aryl)-sulfamoyl)-azidobenzene which are useful as a photosensitive color-forming agent, are utilized for the production of photo-relief and photo-resist.

U.S. Pat. No. 1,845,989 teaches a light-sensitive layer which is produced by coating an alkaline aqueous solution of p-aziododiphenylamine carboxylic acid on paper, and can produce thereon yellowish brown images by imagewise exposure to light.

U.S. Pat. No.3,062,650 teaches a photographic print-out system comprising organic azido, which system is usable for producing colored print-out images consisting of quinoneimine type coloring substances. In the system, a certain type of organic azido compounds are capable of effecting oxidative condensation of p-phenylene-diamine color-developing agents with color-forming couplers containing reactive methylene or methine groups on exposure to light, in order to form indoaniline or azomethine dyes.

However, the above-mentioned types of conventional photosensitive compositions are unsatisfactory in the color-forming property and/or photo-hardening property thereof. Accordingly, in order to satisfactorily color-form or completely harden or insolubilize the conventional photosensitive layer, it is required to increase the close of radiation rays to be directed to the photosensitive layer, add an additive to the layer for promoting the photosensitivity of the layer or increase the amount of the azido compound to be contained in the layer. These requirements make practical utilization of the conventional photosensitive color-forming element disadvantageous.

An object of the present invention is to provide a photosensitive color-forming element including therein a photosensitive azido compound and a color-forming coupler which are capable of forming dark color only when exposed to radiation rays.

Another object of the present invention is to provide a photosensitive color-forming element including therein a photosensitive color-forming azido compound and a color-forming coupler, but not including a color-developing agent which is reacted with the color-forming coupler in order to form a dye.

Still another object of the present invention is to provide a photosensitive color-forming element capable of being developed with an aqueous solution of a non-volatile alkaline substance, for example, sodium hydroxide and sodium metasilicate.

Another object of the present invention is to provide a photosensitive color-forming element which is highly stable during a long storage period and is relatively cheap.

These and other objects of the present invention which will become apparent from the detailed description below, are attained by the photographic color-forming element of the present invention.

The photosensitive color-forming element of the present invention comprises a support, and a photosensitive color-forming layer coated on said support, said layer containing therein at least one color-forming coupler and at least one photosensitive azido compound selected from the group consisting of azido compounds of the formula (I) and azido compounds of the formula (II);

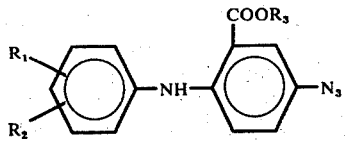

(I)

and

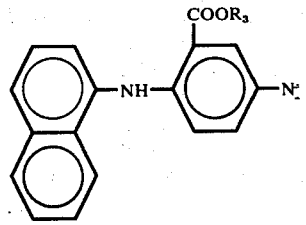

(II)

wherein $R_1$ represents a substituent selected from the group consisting of hydrogen and halogen atoms and alkyl, alkoxyl, diethylamino and hydroxyl radicals, R2 a substituent selected from the group consisting of alkyl, alkoxyl and hydroxyl radicals and $R_3$ a substituent selected from the group consisting of a hydrogen atom and alkyl and phenyl radicals.

In the azido compounds of formula (I), the alkyl radical as $R_1$, $R_2$ and $R_3$ preferably has 1 to 4 carbon atoms and the alkoxyl radical as $R_1$ and $R_2$ referably has 1 to 4 carbon atoms.

The azido compound of the formula (I) usable for the present invention may be selected from the group consisting of 2-(4'-methoxyphenyl)amino-5-azidobenzoic acid,
2-(4'-methylphenyl)amino-5-azidobenzoic acid,
2-(4'-hydroxyphenyl)amino-5-azidobenzoic acid,
2-(3',5'-dimethylphenyl)amino-5-azidobenzoic acid,
2-(2',4'-dimethoxyphenyl)amino-5-azidobenzoic acid,
2-(2'-hydroxy-4'-methylphenyl)amino-5-azidobenzoic acid,
2-(4'-diethylaminophenyl)amino-5-azidobenzoic acid,
2-(4'-chlorophenyl)amino-5-azidobenzoic acid, 2-(2',4'-dimethoxyphenyl)amino-4-azidobenzoic acid, and methyl-, ethyl-, propyl-, butyl- and phenyl-esters of each of the above-mentioned compounds.

The azido compounds of the formulae (I) and (II) usable for the present invention can be respectively prepared from the starting amino compounds of the formulae (III) and (IV).

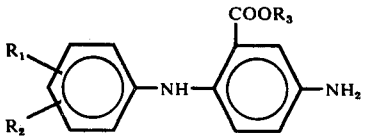

(III)

and

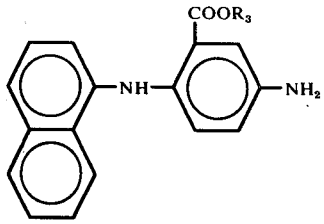

(IV)

wherein $R_1$, $R_2$ and $R_3$ respectively represent the same as mentioned hereinbefore. In the preparation of the azido compounds, the starting amino compound formulated above is dissolved or suspended in water or a mixture of water and an organic solvent, for example, formic acid, acetic acid and dioxane, the solution or suspension is adjusted to an acidic pH by adding an aqueous solution of hydrochloric acid or sulfuric acid, and, thereafter, the starting amino compound is diazotized by adding dropwise an aqueous solution of sodium nitrite or nitrosyl-sulfuric acid at a temperature of 0° to 40° C. After the completion of the diazotization, an aqueous solution of an azido compound of alkali metal, for example, sodium azide and potassium azide, is added to the diazotization mixture at a temperature of 0° to 40° C. The resultant azido compound is isolated by way of filtration and is dried. Generally, the azido compound can be produced in yield of 80% by mole or more.

The color-forming coupler can be selected from compounds usable as a color-forming coupler for producing azo dyes. Such color-forming coupler compounds may be selected from the group consisting of 2-hydroxynaphthalene, 1-hydroxynaphthalene, 2,3-dihydroxynaphthalene, 4-methoxy-1-naphthol, 2-hydroxy-3-naphthanilide, 2,4-dichloro-1-naphthol, phenol, 1,3-dihydroxybenzene, 1,4-dihydroxybenzene, 4-acetylphenol, p-cresol, m-phenylenediamine, 5-methyl-2-acetylphenol, N,N-dimethyl-m-aminophenol, N,N-diethylaniline, N-ethyl-N-benzylaniline, N-methyl-diphenylamine, N,N-bis-cyanoethylaniline, N,N-dibenzylaniline, acetoacetic anilide, 1-phenyl-3-methyl-5-pyrazolone, 1-(4'-chlorophenyl)-3-methyl-5-pyrazolone, 1-naphthyl-3-methyl-5-pyrazolone, 1-(3'-aminophenyl)-3-methyl-5-pyrazolone, 1-methyl-2-phenylindole, 2-phenylindole, 1,2-dimethylindole, 2,3,3-trimethylindoline, 1,2,3,3-tetramethylindoline, 4-hydroxycoumarin and 4-cyanomethyl-nitrobenzene.

In the photosensitive color-forming layer of the present invention, the color-forming coupler is preferably in an amount of at least 50% by mole based on that of the photosensitive azido compound.

The photosensitive color-forming element of the present invention can be provided by the following procedures.

The azido compound of the formula (I) of (II) and the color-forming coupler are dissolved, in a concentration of 1 to 40% by weight in a volatile organic solvent, for example, ethylene glycol monoethyl ether, ethylene glycol monomethyl ether, ethylene glycol monoethyl ether acetate, cyclohexane, cyclohexanone, methyl ethyl ketone, dioxane, dimethylformamide, lower alkanols, dichloroethane, tetrahydrofurane, toluene, xylene, butyl acetate and mixtures of two or more of the above-mentioned compound. The resultant solution is applied at a desired thickness onto one or two surfaces of a support by way of immersion, whirl-coating, brushing, doctor-blade, reverse roll coating, gravure coating or spraying. The solution layer thus formed is dried so as to form a photosensitive color-forming layer on the support surface.

The support usable for the photosensitive color-forming element of the present invention may be in the form of film, sheet, fabric web, plate or other shaped articles and consists of a cellulose ester, for example, cellulose diacetate, cellulose triacetate and cellulose acetate butylate; a polyester, for example, polyethylene terephthalate; a poly-$\alpha$-olefin consisting of a polymerized component monomer having 2 to 10 carbon atoms, for example polyethylene and polypropylene; a polystyrene; a polycarbonate; paper; a metal, for example, aluminum, zinc, copper and steel; and paper coated with one or more of the above-mentioned polymeric materials.

The above-mentioned photosensitive color forming element can be utilized in various ways, such as for copying sheets, copying negative sheets and microfilm.

In order to utilize the photosensitive color-forming element of the present invention, for example, as a photo-resist, photo-relief, various printing plates (offset, presensitized and rotary photogravure plates), printed circuit boards and chemically etched metallic materials (shadow mask of color Braun tube), it is desirable that the photosensitive color-forming layer further contains therein a polymeric material capable of hardening or being non-solubilized in solvent in the presense of the photosensitive azido compound available for the present invention when the polymeric material is exposed to radiation rays, for example, sun light and ultra-violet rays.

The polymeric material may be selected from the class consisting of novolak resins, modified novolak resins containing at least one compound other than phenol and formaldehyde, styrene-butadiene copolymers, cyclized rubbers, polybutadine and polyvinyl alcohol to which acrylonitrille or acrylamide is graft-polymerized. Generally, alkali-soluble phenol novolak resins and modified novolak resins modified with m-cresol, p-cresol, p-tert-butyl-phenol or cashew nut shell oil are most preferable as the polymeric material to be contained in the photosensitive color-forming layer. It is preferable that in the photosensitive color-forming layer of the present invention, the sum of the amounts of the color-forming coupler and the photosensitive azido compound is 15 to 45% based on the weight of said polymeric material, in response to use of the element, type of the azido compound, the color-forming coupler and the polymeric materials.

When the photosensitive color-forming layer is exposed to radiation rays, the azido compound specified in the present invention can act as a polymerization initiator so as to promote the polymerization, intermolecular or intramolecular cross-linking reaction or condensation reaction of the polymeric material. As a result, the exposed portion of the photosensitive color-forming layer is hardened or insolubilized in solvent.

In the preparation of the photosensitive color-forming layer on the support, it is important that the color-forming coupler and the solvent to be mixed with a polymeric material, substantially do not retard the hardening or insolubilizing reaction of the polymeric material. Generally, a sum of the concentrations of the azido compound, color-forming coupler and the polymeric material is preferably about 5 to about 50% by weight calculated in terms of solid contents thereof.

The photosensitive color-forming layer of the present invention may further contain one or more additives, that is, anti-oxidizing agent, anti-static agent, polymerization accelerater, inhibiter, retarder, adhesive, activator, viscosity-controlling agent, coloring material or other solid materials, for example, colloidal silica, clay, titanium dioxide, calcium sulfate and barium sulfate.

The photosensitive color-forming element can be stored for a long period of time, for example, 6 months or more, without changing the quality (developing property) of the photosensitive color-forming layer.

In order to produce the desired color images, the photosensitive color-forming layer is imagewise exposed for a predetermined time, for example, 5 seconds to 5 minutes, to radiation rays from sun or conventional artificial light sources, for instance, a carbon-arc lamp, mercury-arc lamp, chemical lamp, or xenon lamp. During the exposure period, the exposed portions of the photosensitive color-forming layer produce color images in response to the type of azido compound and the color-forming coupler used. If the layer contains polymeric material, the exposed portions are hardened and insolubilized in solvent. After the completion of the exposure operation, the photosensitive color-forming layer is developed with a developer liquid to remove the non-exposed portion of the layer. Generally, the developer liquid is an aqueous solution containing a non-volatile alkali metal compound, for instance, sodium hydroxide and sodium metasilicate. The developer liquid may contain therein an organic solvent, for example, trichloroethylene, methyl alcohol, ethyl alcohol, toluen, xylene or methyl ethyl ketone. After the development, the photosensitive color-forming element is washed with water and is dried. The images thus produced have a dark color, for instance, black, brown, dark brown, dark green, dark blue black, blue green or blue violet, in response to the type of azido compound and color-forming coupler used. If the photosensitive color-forming layer contains polymeric material, the resultant resinous color images have a high rigidity, hardness, ink-receptivity (oleophilic property) and an excellent resistance to abrasion and to acid corrosion.

The present invention will be further illustrated by the following examples which are given by way of illustration and not as limitations of the scope of the present invention. In the following examples, the parts and percentages are by weight unless otherwise stated.

PREPARATION OF AZIDO COMPOUND

EXAMPLE A 2-(1′-naphthyl) amino-5-azidobenzoic acid was prepared by the following procedures.

Hydrochloride of 2-(1′-naphthyl) amino-5-aminobenzoic acid in an amount of 38.9 parts was dissolved in a mixture solvent consisting of 180 parts of water, 150 parts of glacial acetic acid, 150 parts of dioxane, and 10 parts of concentrated hydrochloric acid was added to the solution. To the solution was added dropwise 81 parts of an aqueous solution containing 10% of sodium nitrite at a temperature of 0° to 5° C. After the completion of the addition, the mixture was stirred for 1 hour at the above-mentioned temperature and filtered. 98 parts of an aqueous solution containing 10% of sodium azide were added to the filtrate and the reaction mixture was stirred at a temperature of 0° to 10° C for 1 hour to prepare the desired azido compound from the 2-(1-naphthyl) amino-5-aminobenzoic acid diazotized above. The resultant azido compound which has been precipitated from the reaction mixture, was isolated by a filtration and dried. The yielding was 27.6 parts of 2-(1-naphthyl) amino-5-azidobenzoic acid having a melting (decomposing) point of 162° C.

EXAMPLE B 2-(4′-methylphenyl)amino-5-azidobenzoic acid was prepared by the following operation.

Hydrochloride of 2-(4′-methylphenyl)amino-5-aminobenzoic acid in an amount of 32.4 parts was dissolved in 600 parts of water. The solution was, mixed with 10 parts of concentrated hydrochloric acid. To the solution thus prepared were added dropwise 81 parts of an aqueous solution of 10% of sodium nitrite at a temperature of 10° to 20° C. After the addition was completed, the mixture was stirred for 1 hour while maintaining it at the above temperature, then, filtered. To the filtrate were added 98 parts of an aqueous solution of 10% sodium azide. The reaction mixture was stirred for 1 hour at a temperature between 20° and 30° C to convert the starting compound to the desired azido compound.

The resultant azido compound which had been precipitated from the reaction mixture, was separated by way of filtration and dried. The yield was 30.2 parts of 2-(4′-methylphenyl)amino-5-azidobenzoic acid having a melting (decomposing) point of 158° C.

EXAMPLE C 2-(4′-methoxyphenyl)amino-5-azidobenzoic acid was prepared by following the procedures outlined in Example A and using 34.3 parts of hydrochloride of 2-(4′-methoxyphenyl)amino-5-aminobenzoic acid, a mixture solvent consisting of 300 parts of glacial acetic acid, 180 parts of dioxane and 180 parts of water. The yield was 32.7 parts of 2-(4′-methoxyphenyl) amino-5-azidobenzoic acid having a melting (decomposing) point of 163° C.

PREPARATION OF A PHOTOSENSITIVE COLOR-FORMING ELEMENT

EXAMPLE 1 AND COMPARISON EXAMPLE 1

In Example 1, a photosensitive color-forming composition was prepared by dissolving 1.5 parts of 2-(1′-naphthyl)amino-5-azidobenzoic acid, 1.0 part of 4-methoxy-1-naphthol and 5.0 parts of a novolak resin modified with m-cresol and dissolved in 65.0 parts of ethylene glycol monomethyl ether.

A piece of polyethylene terephthalate film was set up on a whirler. The above-prepared solution was applied onto the surface of the polyethylene terephthalate film while rotating the whirler at a velocity of 75 r.p.m. to coat the film surface with the solution. The applied solution was dried at a temperature of 50° C in a hot air drier to completely remove the solvent. A thin layer of the photosensitive composition having a thickness of 3.5 $\mu$ was formed on the film surface. A photosensitive color-forming element was obtained.

The photosensitive color-forming layer of the element was covered with a negative film having thereon a preset image pattern, and exposed for 90 seconds to radiation rays from a 2 KW super high voltage mercury-arc lamp at a distance of 1 m. The exposed photosensitive color-forming layer was developed by immersion in an aqueous solution of 1.4% trisodium phosphate. During development, the nonexposed portions of the photosensitive layer were dissolved into the developing solution and the exposed portions of the photosensitive layer were hardened, were dark green and were left on the film surface. That is, distinct dark green images were formed on the film surface. The transmission density of the images was 1.30 which was determined by means of a transmission densitometer using a green filter in accordance with the method mentioned in ASA PH 2.19–1959.

The photosensitive color-forming element was very stable over a long period of storage to such an extent that even after 6 months storage, no decrease was found in the developing property of the photosensitive color-forming layer and ever after a storage of 10 months, the time required to completely develop the stored photosensitive color-forming layer was only about 6 seconds longer than that required for a fresh layer.

In Comparison Example 1, procedures identical to those in the above example were repeated using p-azidodiphenylamine carboxylic acid of the formula:

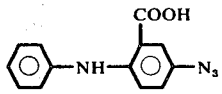

which is disclosed in U.S. Pat. No. 1,845,989 Example 4 instead of 2-(1′-naphthyl)amino-5-azidobenzoic acid.

The images developed on the comparison element were greenish-blue and had a relatively low transmission density of 1.02.

EXAMPLE 2 AND COMPARISON EXAMPLE 2

In Example 2, operations identical to those in Example 1 were carried out using, in place of 4-methoxy-1-naphthol, 1.1 parts of 2,4-dichloro-1-naphthol. The images developed on the element were dark blue and had a transmission density of 1.35.

In Comparison Example 2, the same operations as those in Example 2 were repeated, except that p-azidodiphenylamine carboxylic acid was used instead of 2-(1′-naphthyl)amine-5-azidobenzoic acid.

The images developed on the comparison element were dark blue and had a relatively small transmission density of 1.07.

EXAMPLES 3, 4 AND 5 AND COMPARISON EXAMPLE 3

In Example 3, in order to prepare a support for a photosensitive color-forming element, a zinc plate having a 1.0 mm thickness for photo-relief was sandpapered and treated with an aqueous solution of 5% of acetic acid to form a rough surface thereon. The zinc plate was washed with water and completely dried so as to leave no water drops thereon.

A photosensitive composition consisting of 1.5 parts of 2-(4′-methylphenyl)amino-5-azidobenzoic acid, 0.8 parts of 2-naphthol and 5.0 parts of phenol novolak resin was dissolved in ethylene glycol monoethyl ether.

The solution thus prepared was applied onto a surface of the above-rough surfaced zinc plate by means of a doctor blade and dried at a temperature of 80° C in a hot air drier so as to completely eliminate the solvent from the resultant photosensitive color-forming layer on the element. A photosensitive color-forming layer having a thickness of 4.0 $\mu$ was formed.

The photosensitive color-forming layer was covered with a negative film having a predetermined network pattern thereon. The layer was exposed for 90 seconds through the negative film, to radiation rays from a 2 KW super high voltage mercury-arc lamp at a distance of 1 m. The photosensitive color-forming layer thus exposed was developed by immersion in an aqueous solution of 1% of sodium meta-silicate so as to completely dissolve the non-exposed portion thereof. The resultant images were bluish-green and had a transmission density of 1.14.

The element thus developed was washed with water. Even after washing, the image layer had a rigidity sufficient for a photo-resist. Accordingly, the water-washed element could be subjected directly to an etching operation, without any pre-treatment such as burning, to prepare a photo-relief for printing.

The photosensitive color-forming element of the present example was very stable over a long period of storage. For example, even after a storage period of 6 months, no change was found in the developing property of the photosensitive color-forming layer thereof, and after 10 months storage, the time required to completely develop the stored photosensitive color-forming layer was only 7 seconds longer than that of a fresh photosensitive layer.

In Examples 4, and 5 the same procedures as those in Example 3 were repeated twice using 4-acetophenol (Example 4) and 1,4-dihydroxybenzene (Example 5) instead of 2-naphthol. The images of Example 4 were greyish-black and had a transmission density of 0.80 and the images of Example 5 were dark green and had a transmission density of 1.20.

In Comparison Example 3, procedures identical to those in Example 3 were repeated using 4,4-diazidostilbene-2,2′-disulfonic acid anilide instead of the 2-naphthol. It was observed that in the exposure operation, when a step tablet No. 2 (Eastman Kodak) was used, the number of remaining steps was less by 4 steps than that of Example 3.

EXAMPLE 6 AND COMPARISON EXAMPLE 4

In Example 6, a photosensitive color-forming composition consisting of 1.5 parts of 2-(4′-methoxyphenyl- )amino-5-azidobenzoic acid, 1.1 parts of 2.4-dichloro-1-naphthol, 0.2 parts of Michler's hydrol (N,N'-tetramethyl-4,4'-diaminobenz-hydrol) and 5.0 parts of a novolak resin modified with m-cresol were dissolved in 65 parts of ethylene glycol monomethyl ether.

A piece of cellulose triacetate film was set up on a whirler. The solution prepared above was applied onto a surface of the cellulose triacetate film while rotating the whirler at a velocity of 75 r.p.m. The coating of the solution formed on the cellulose triacetate film surface was completely dried at a temperature of 60° C in a hot air drier. A photosensitive color-forming layer having a thickness of 3.7 $\mu$ was formed on the cellulose triacetate film surface.

The photosensitive color-forming element thus prepared was covered on its photosensitive color-forming layer with a negative film having a predetermined image pattern and imagewisely exposed to radiation rays from a 160 W chemical lamp at a distance of 10 cm for 120 seconds. After the completion of exposure, the exposed photosensitive color-forming layer was developed by immersion in an aqueous solution of 2.5% of trisodium phosphate so as to completely dissolve the non-exposed portions of the layer. The images thus developed were bluish-green and had a transmission density of 1.56.

In Comparison Example 4, the same operations as those in Example 6 were carried out using p-azidodiphenylamine carboxylic acid in place of the 2-(4'-methoxyphenyl)amino-5-azidobenzoic acid. The resultant developed images were bluish-green and had a relatively small transmission density of 1.07.

EXAMPLES 7 THROUGH 19

Procedures identical to those in Example 1 were repeated in each of Examples 7 through 19 using the azido compound and color-forming coupler indicated in the following table. The resultant images in each example had the color and transmission density indicated in the table.

For comparison, operations identical to those in each of Examples 7 through 19 were repeated using p-azidodiphenylamine carboxylic acid as the azido compound. The images developed in each of the comparison examples had a color and a transmission density shown in parenthesises, in the table.

| Example No. | Azido compound | Color-forming coupler | Image color | Transmission density |
|---|---|---|---|---|
| 7 | 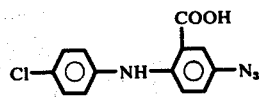 | 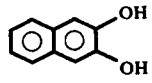 | Blue Blue-violet) | 1.20 (0.95) |
| 8 | 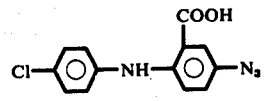 | 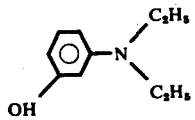 | Blue-violet (Violet) | 1.25 (0.99) |
| 9 | 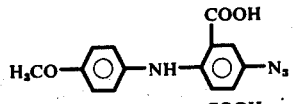 | 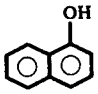 | Blue-green (Greenish blue) | 1.31 (1.03) |
| 10 | 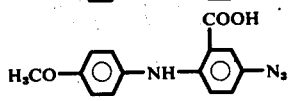 | 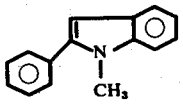 | Orange-red (Orange) | 0.80 (0.70) |
| 11 | 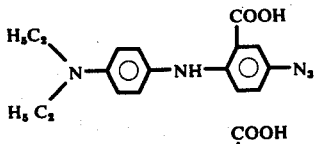 | 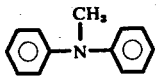 | Dark-blue (Blue) | 1.15 (0.95) |
| 12 | 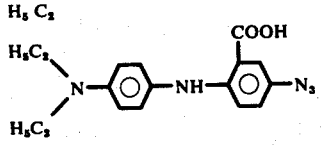 | 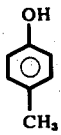 | Blue (Violet) | 0.91 (0.75) |
| 13 | 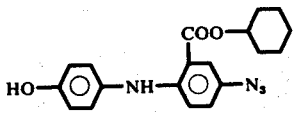 | 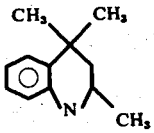 | Bluish-black (Dark blue) | 1.00 (0.79) |
| 14 | 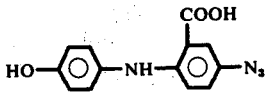 | 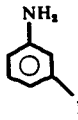 | Black (Bluish black) | 1.32 (1.03) |
| 15 | 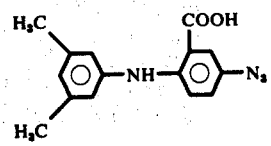 | 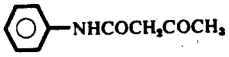 | Orange (Yellowish orange) | 0.85 (0.65) |

-continued

| Example No. | Azido compound | Color-forming coupler | Image color | Transmission density |
|---|---|---|---|---|
| 16 | 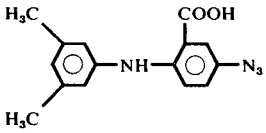 | 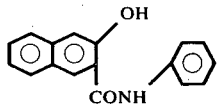 | Blue (Blue-violet) | 1.29 (1.05) |
| 17 | 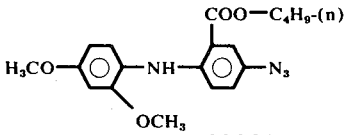 | 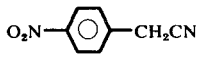 | Red (Orange) | 0.84 (0.70) |
| 18 | 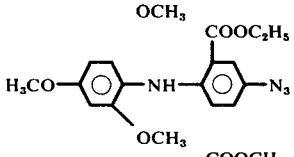 | 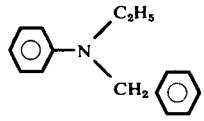 | Blue-violet (Violet) | 1.18 (0.96) |
| 19 | 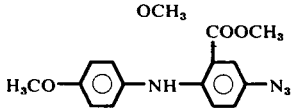 | 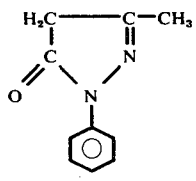 | Brown (Red-brown) | 0.75 (0.65) |

What we claim is:

1. A photosensitive color-forming element comprising a support, and a photosensitive color-forming layer coated on said support, said layer containing therein an admixture of:

A. at least one color-forming coupler selected from the group consisting of 2-hydroxynaphthalene, 1-hydroxynaphthalene, 2,3-dihydroxynaphthalene, 4-methoxy-1-naphthol, 2-hydroxy-3-naphthanilide, 2,4-dichloro-1-naphthol, phenol, 2,4-dihydroxybenzene, 1,4-dihydroxybenzene, 4-acetylphenol, p-cresol, m-phenylenediamine, 5-methyl-2-acetylphenol, N,N-dimethyl-m-amino-phenol, N,N-diethylaniline, N-ethyl-N-benzylaniline, N-methyldiphenyl amine, N,N-bis-cyano-ethylaniline, N,N-dibenzylaniline, acetacetic anilide, 1-phenyl-3-methyl-5-pyrazolone, 1-(3'-aminophenyl)-3-methyl-5-pyrazolone, 1-(4'-chlorophenyl)-3-methyl-5-pyrazolone, 1-nathyl-3-methyl-5-pyrazolone, 1-methyl-2-phenylindole, 2-phenylindole, 1,2-dimethylindole, 2,3,3-trimethylindoline, 1,2,3,3-tetramethylindoline, 4-hydroxycoumarin and 4-cyanomethyl-nitrobenzene, and B. at least one photosensitive azido compound selected from the group consisting of the azido compounds of the formula (I) and the azido compound of the formula (II):

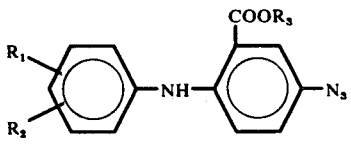

(I)

and

-continued

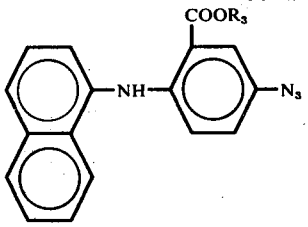

(II)

wherein $R_1$ represents a substituent selected from the group consisting of halogen atoms, and alkoxyl, diethylamino and hydroxyl radicals, $R_2$ a substituent selected from the group consisting of alkoxyl and hydroxyl radicals, and $R_3$ a substituent selected from the group consisting of a hydrogen atom and alkyl and phenyl radicals.

2. A photosensitive color-forming element as claimed in claim 1, wherein said photosensitive azido compound of the formula (I) is selected from the group consisting of 2-(4'-methoxyphenyl)amino-5-azidobenzoic acid,
2-(4'-methylphenyl)amino-5-azidobenzoic acid,
2-(4'-hydroxyphenyl)amino-5-azidobenzoic acid,
2-(3',5'-dimethylphenyl)amino-5-azidobenzoic acid,
2-(2',4'-dimethoxyphenyl)amino-5-azidobenzoic acid,
2-(2'-hydroxy-4'-methylphenyl)amino-5-azidobenzoic,
2-(4'-diethylaminophenyl)amino-5-azidobenzoic acid,
2-(4'-chlorophenyl)amino-5-azidobenzoic acid,
2-(2',4'-dimethoxyphenyl)amino-5-azidobenzoic acid, and methyl-, ethyl-, propyl-, butyl- and phenyl-esters of each of the above-mentioned compounds.

3. A photosensitive color-forming element as claimed in claim 1, wherein said photosensitive color-forming layer further contains therein a polymeric material capable of hardening or being non-solubilized in solvent when said polymeric material is exposed to radiation rays in the presence of said photosensitive azido compound.

4. A photosensitive color-forming element as claimed in claim 3, wherein said polymeric material is selected from the class consisting of novolak resins, modified novolak resins containing at least one compound other than phenol and formaldehyde, styrene-butadiene copolymers, cyclized rubbers, polybutadine and polyvinyl alcohol to which acrylonitrile or acrylamide is graft-polymerized.

5. A photosensitive color-forming element as claimed in claim 1, wherein said color-forming coupler is in an amount of at least 50% by mole based on that of said photosensitive azido compound.

6. A photosensitive color-forming element as claimed in claim 5, wherein a sum of the amount of said color-forming coupler and said photosensitive azido compound is 15 to 45% based on the weight of said polymeric material.

7. A photosensitive color-forming element as claimed in claim 1, wherein said alkyl radical as said $R_1$, $R_2$ and $R_3$ has 1 to 4 carbon atoms.

8. A photosensitive color-forming element as claimed in claim 1, wherein said alkoxyl radical as said $R_1$ and $R_2$ has 1 to 4 carbon atoms.

9. A photosensitive color-forming element as claimed in claim 1, wherein said support consists of cellulose diacetate, cellulose triacetate, cellulose acetate butylate, polyethylene, polypropylene, polystyrene, polyethylene terephthalate, polycarbonate, zinc, aluminum, copper, steel, paper and papers coated with one or more of said above-mentioned polymeric materials.

* * * * *

UNITED STATES PATENT OFFICE

CERTIFICATE OF CORRECTION

Patent No. 4,003,747 Dated January 18, 1977

Inventor(s) Takahiro Tsunoda et al.

It is certified that error appears in the above-identified patent and that said Letters Patent are hereby corrected as shown below:

In column 2, the second formula "N " should be --$N_3$--;

In column 9, line 1, "2.4-dichloro" should be --2,4-dichloro--;

In comparative example 13, "H" was deleted from the color forming coupler which should appear as follows:

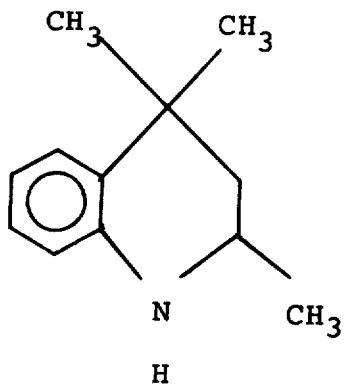

Signed and Sealed this

Twenty-first Day of June 1977

[SEAL]

*Attest:*

RUTH C. MASON
*Attesting Officer*

C. MARSHALL DANN
*Commissioner of Patents and Trademarks*